US005717451A

United States Patent [19]

Katano et al.

[11] Patent Number: 5,717,451

[45] Date of Patent: Feb. 10, 1998

[54] POSITIONING SYSTEM FOR MULTIHEAD TYPE IMAGE RECORDING APPARATUS

[75] Inventors: Tatsuya Katano, Fujisawa; Shigeru Iemura, Chigasaki, both of Japan

[73] Assignee: Matsushita Graphic Communication Systems, Inc., Tokyo, Japan

[21] Appl. No.: 524,929

[22] Filed: Sep. 8, 1995

[30] Foreign Application Priority Data

Sep. 8, 1994 [JP] Japan ..... 6-214693

[51] Int. Cl.[6] ..... B41J 2/47

[52] U.S. Cl. ..... 347/242; 347/257

[58] Field of Search ..... 347/242, 238, 347/241, 256, 257

[56] References Cited

U.S. PATENT DOCUMENTS 4,661,828 4/1987 Miller, Jr. et al. ..... 347/242

4,875,057 10/1989 Hediger et al. ..... 347/242

*Primary Examiner*—Mark J. Reinhart

*Attorney, Agent, or Firm*—Lowe, Price, LeBlanc & Becker

[57] ABSTRACT

A multihead type image recording apparatus is provided. This recording apparatus includes a single position detector and a position correcting circuit. The position detector detects positional components of an array of laser diodes of each of recording heads in an X-direction parallel to a traveling direction of the recording heads on a recording medium and a Y-direction perpendicular to the X-direction to determine an inclination of the laser diode array. The position correcting circuit adjusts the inclination of the laser diode array of each of the recording heads to a given common angle to compensate for a positional error in the X-direction of the laser diode array, and also controls timing of activation of the laser diodes to compensate for a positional error in the Y-direction of the laser diode array.

9 Claims, 10 Drawing Sheets

POSITIONING SYSTEM FOR MULTIHEAD TYPE IMAGE RECORDING APPARATUS

BACKGROUND OF THE INVENTION

1. Technical Field

The present invention relates generally to an image recording apparatus which records images on a recording medium such as a sublimation film or a fusible film using multiple laser beams, and more particularly to an improved structure of a multihead type image recording apparatus which is designed to correct positions of laser beam spots on a recording medium with high accuracy.

2. Background Art

FIG. 12 shows a conventional image recording apparatus which has a plurality of laser beam diodes (LD) disposed in a recording head 1 for producing multiple beam spots simultaneously. Laser beams from the LDs are focused through a collimator lens and an objective onto a recording medium 3 such as a film attached to an outer surface of a drum 2 to form image-recording laser beam spots. The image-recording laser beam spots are then scanned by a linear motor 4 on the recording medium 3, and output powers of the LDs are controlled according to image signals to record images on the recording medium 3.

This conventional image recording apparatus performs the scanning operation using the single recording head 1, and thus has the limit of recording high-quality images at high speeds.

As techniques for recording images at high speed and high resolution, it is known to increase the power of laser beams to shorten a recording time. However, In a multimode laser used in such a conventional image-recording apparatus, if the power of laser beams is set to, for example, 500 mW, the width of the laser beams will be 50 μm or more. Laser beams having such width form spots having an unsuitable size for recording images on a recording medium. Producing microspots requires a complex structure of a condenser lens system.

It is also possible to perform a high-speed recording operation using a multi-recording head system. This system drives a plurality of recording heads at the same time for one sheet of recording paper. Thus, due to inevitable variations in mechanical properties between the recording heads, it is difficult to maintain the continuity between images on the recording paper. A bulky and complex correction device is thus required.

SUMMARY OF THE INVENTION

It is therefore a principal object of the present invention to avoid the disadvantages of the prior art.

It is another object of the present invention to provide an improved structure of a multihead type image recording apparatus which is designed to accurately correct the positions of laser beam spots on a recording medium in a decreased period of time for recording high-quality images.

According to a first aspect of the present invention, there is provided an image recording apparatus which comprises a plurality of recording heads each emitting a beam spot to form an image on a recording medium provided on a rotatable drum, a moving means for moving the recording heads along a given traveling path substantially perpendicular to a rotational direction of the drum, a position detecting means for detecting positions of the beam spots emitted from the recording heads on the recording medium, respectively, to provide position signals indicative thereof, and a correcting means for correcting a position of each of the recording head relative to the recording medium based on the position signals provided by the position detecting means.

In the preferred mode of the invention, the position detecting means determines positional components of each of the beam spots in a first direction parallel to the rotational direction of the drum and in a second direction perpendicular to the rotational direction of the drum.

Each of the recording heads includes an array of light-emitting elements arranged in alignment with each other which emit a plurality of beam spots onto the recording medium. The position detecting means determines an inclination of the array of light-emitting elements of each of the recording heads relative to a direction perpendicular to the rotational direction of the drum based on the positional components of the beam spots detected. The correcting means corrects the inclination of the array of light-emitting elements of each of the recording heads to a given common angle for compensating for positional errors in the second direction of the beam spots on the recording medium, and also corrects timing of activation of the light-emitting elements of each of the recording heads for compensating for positional errors in the first direction of the beam sports on the recording medium.

According to a second aspect of the invention, there is provided an image recording apparatus which comprises a plurality of recording heads each emitting a beam spot to form an image on a recording medium provided on a rotatable drum, a moving means for moving the recording heads along a given traveling path substantially perpendicular to a rotational direction of the drum, a single position detector detecting positions of the beam spots emitted from the recording heads on the recording medium, respectively, and a control means for controlling the moving means to move each of the recording heads to a corresponding record-starting position on the traveling path based on the positions of the beam spots detected by the position detector.

In the preferred mode of the invention, a position detecting means is further provided for detecting an absolute position of each of the recording heads on a scale provided along the given traveling path for moving each of the recording heads to a corresponding record-starting position.

According to a third aspect of the invention, there is provided an image recording apparatus which comprises a plurality of recording heads each forming an image on a recording medium provided on a rotatable drum, moving units provided one for each of the recording heads, each of the moving units moving a corresponding one of the recording heads along a given traveling path substantially perpendicular to a rotational direction of the drum within a corresponding one of image-recording areas on the recording medium, and a control means for controlling the moving units to move the recording heads independently.

According to a fourth aspect of the invention, there is provided an image recording apparatus which comprises a plurality of recording heads each forming an image on a recording medium provided on a rotatable drum, moving units provided one for each of the recording heads, each of the moving units moving a corresponding one of the recording heads along a given traveling path substantially perpendicular to a rotational direction of the drum within a corresponding one of image-recording areas on the recording medium, a failure detecting means for detecting failures of the recording heads, and a control means for controlling the moving units to move failing one of the recording heads to a given storage space, the control means also controlling the other of the recording heads so as to cover all of the image-recording areas.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:

FIG. 6(*c*) is an explanatory view which shows detection of laser beams emitted from laser diodes arranged at both ends of a laser diode array, passing through a PSD;

DESCRIPTION OF THE PREFERRED EMBODIMENT

Figure 1:
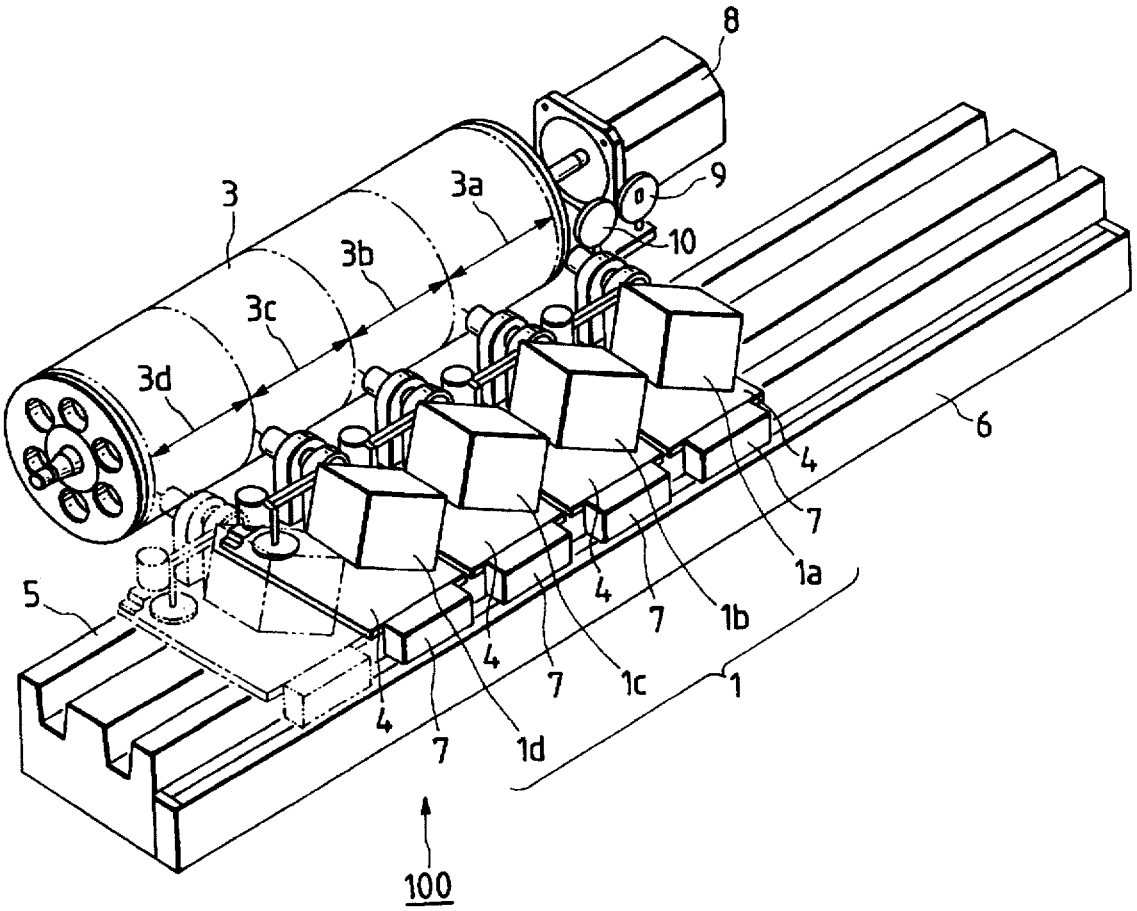
FIG. 1 is a perspective view which shows a head arrangement of an image recording apparatus according to the present invention.

Referring now to the drawings, particularly to FIG. 1, there is shown a multihead type image recording apparatus 100 according to the present invention.

The image recording apparatus 100 generally includes a recording head assembly 1, a drum 2, carriages 4, a linear motor 5, a linear scale 6, position sensors 7, an electric motor 8, a position sensing detector (PSD) 9, and a power monitor 10.

The recording head assembly 1 consists of four recording heads 1*a* to 1*d* disposed in parallel on the carriages 4. Each of the recording heads 1*a* to 1*d* is moved independently by the linear motor 5 along a given traveling path as to emit a plurality of laser beams (e.g., 10 laser beams) to form spots in a corresponding one of four recording-areas 3*a* to 3*d* defined on a recording medium 3 wrapped about the drum 2. Each of the recording heads 1*a* to 1*d* has a known structure wherein an array of laser beam diodes (LDs) is arranged in alignment with each other. An inclination of the array of the LDs with respect to the traveling direction of the recording head assembly 1 (i.e., the lengthwise direction of the drum 2) is changed by a motor mounted on each of the recording heads to change the resolution of images for providing a plurality of linear densities, which are detected by a mounted sensor.

The recording medium 3 may be formed with a sublimation film or a fusible film.

The carriages 4 are moved independently by the linear motor 5 to displace the recording heads 1*a* to 1*d* in a sub-scanning direction (hereinafter, referred to as an X-direction). The carriages 4 may alternatively be moved by any other known mechanism using a ball screw, for example.

The linear scale 6 is disposed along a traveling path of the linear motor 5 (i.e., the carriages 4). The position sensors 7 each measure an absolute position of a corresponding one of the recording heads 1*a* to 1*d* on the linear scale 6. The motor 8 rotates the drum 2 in a main scanning direction (hereinafter, referred to as a Y-direction) perpendicular to the sub-scanning direction. The power monitor 10 includes a photo diode to detect the degree of power of LD beam spots radiated by the recording head assembly 1.

The PSD 9 detects the X- and Y-directions at substantially the same time. In this embodiment, the PSD 9 includes a one-dimentional detecting element to provide an output of the Y-direction only. An output of the X-direction is derived based on positional information provided by the linear scale 6, as will be explained later in detail. The PSD 9 may alternatively be provided with a two-dimentional detecting element to derive positional information on both the X- and Y-directions.

Figure 5:
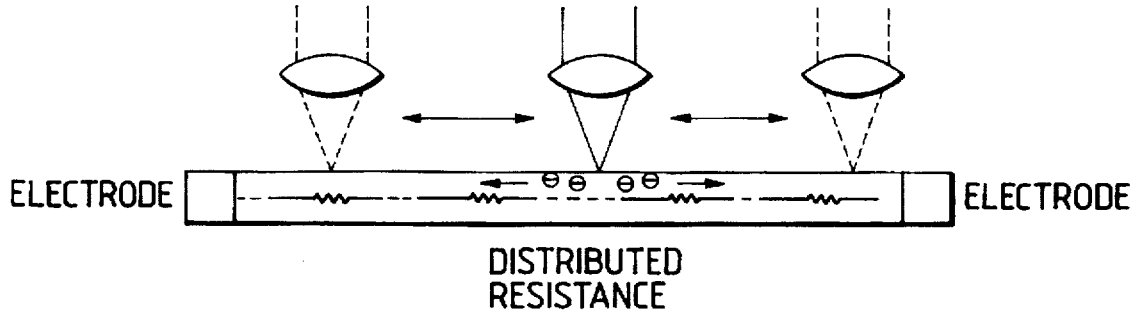
FIG. 5 is an explanatory view which shows the principle of positional detection of a laser beam spot using a PSD.

The PSD 9 is of a type of so-called photoelectric transfer element which, as shown in FIG. 5, includes a slit resistor providing charge through electrodes at both sides, which is produced by a variation in voltage-divided resistance according to positions of LD beam spots radiated by the recording heads 1*a* to 1*d*.

Figure 4:
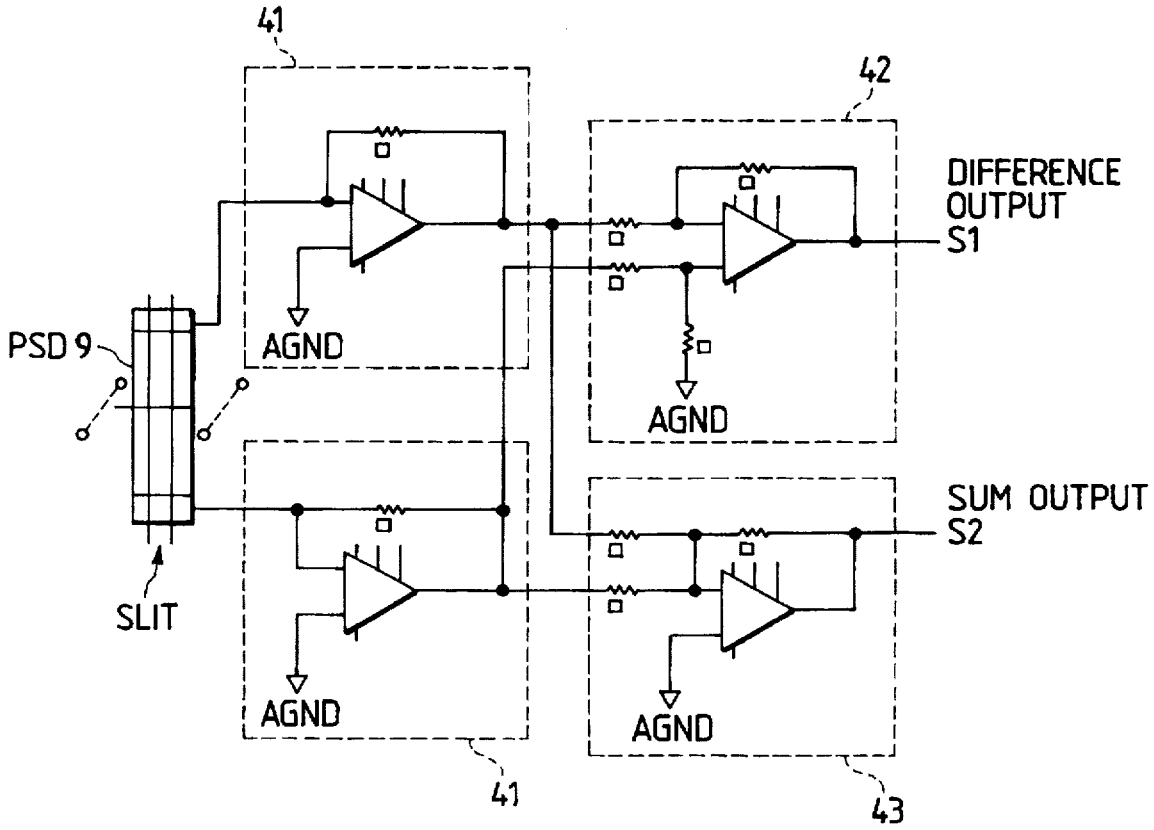
FIG. 4 is a circuit diagram which shows a position sensing detector (PSD) circuit.

FIG. 4 shows an example of a PSD circuit using the PSD 9. The PSD circuit includes current-to-voltage converters (hereinafter, referred to as I-V converters) 41 and comparators 42 and 43. The I-V converters 41 are connected to the electrodes of the PSD 9. The comparator 42 determines a difference in output between the I-V converters 41 to provide a difference output S1, while the comparator 43 determines the sum of the outputs from the I-V converters 41 to provide a sum output S2.

Figure 2:
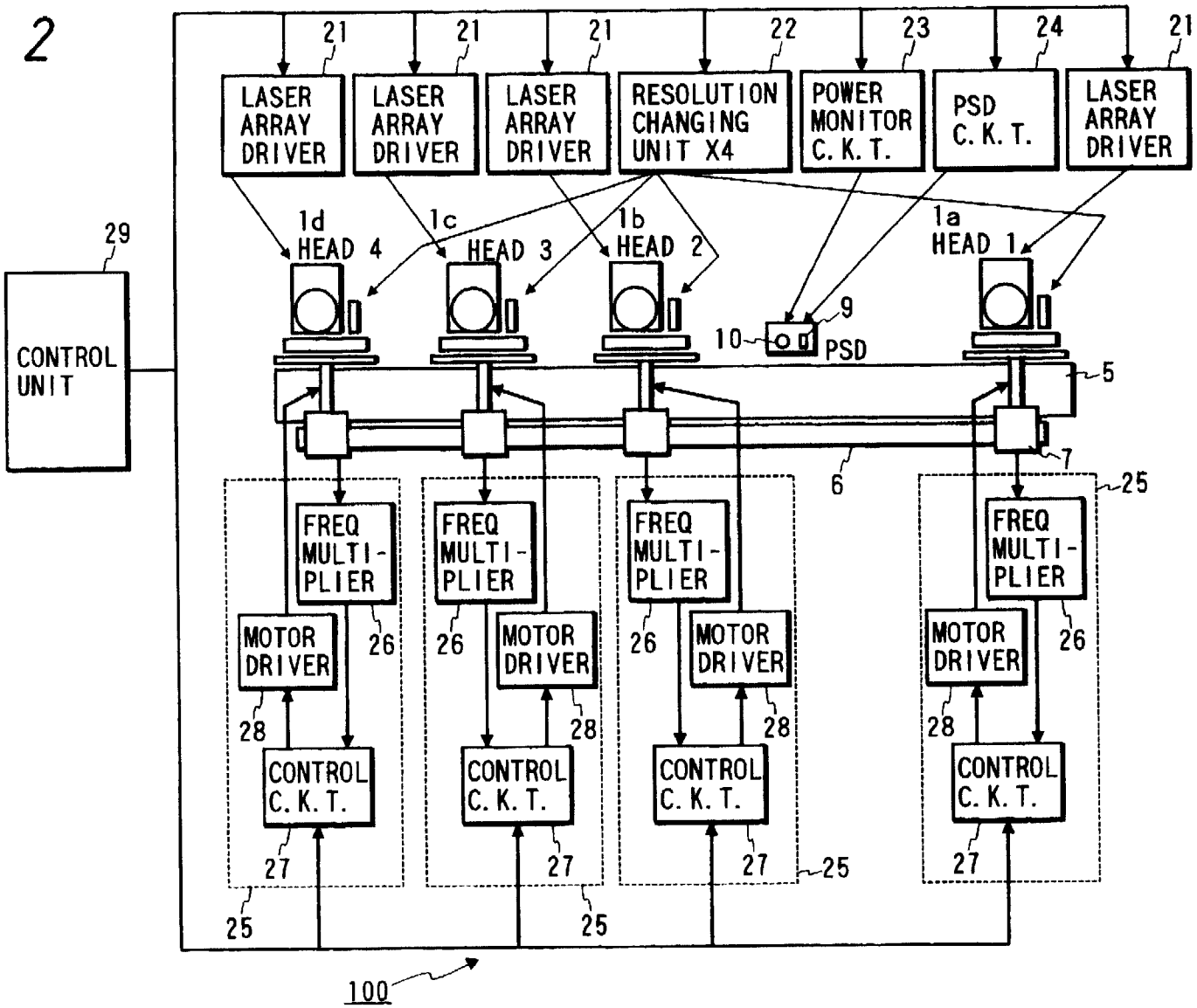
FIG. 2 is a block diagram which shows an image recording apparatus.

The image recording apparatus 100, as shown in FIG. 2, further includes four laser array drivers 21, a resolution-changing motor driver unit 22, a power monitor circuit 23, a PSD circuit 24, four scanning controllers 25, and a control unit 29.

Figure 3:
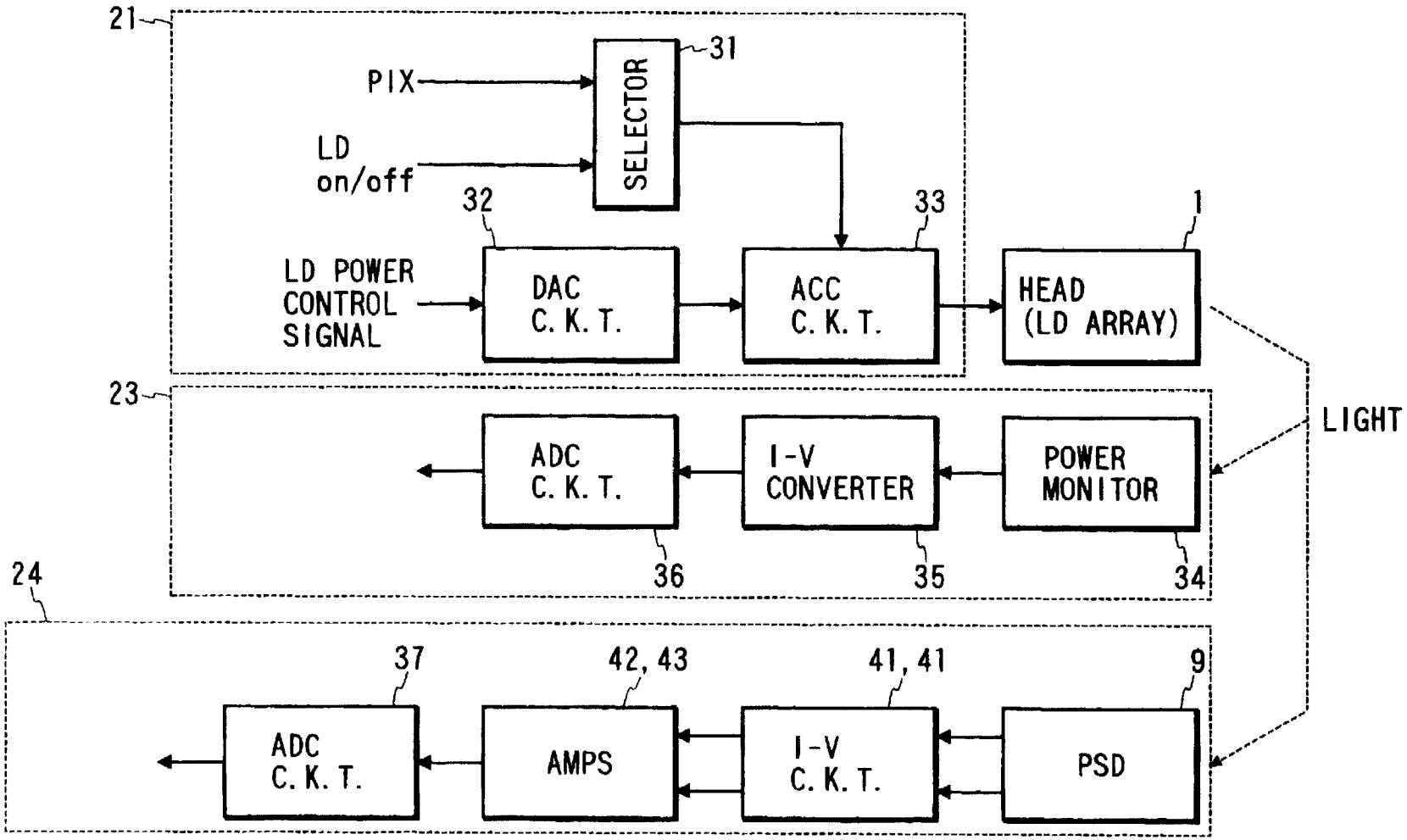
FIG. 3 is a block diagram which shows main circuit arrangements of an image recording apparatus.

Each of the laser array drivers 21, as shown in FIG. 3, includes a selector 31, a DAC (Digital-to-Analog Converter) 32, and an ACC (Automatic Current Control) circuit 33. The selector 31 receives a pixcel signal (PIX) and a laser beam (LD beam). The DAC 32 is responsive to a control signal outputted from the control unit 29 to provide an analog voltage signal. The ACC circuit 33 is responsive to an output from the DAC 32 to control a driving current supplied to the laser array of a corresponding one of the laser heads 1*a* to 1*d*.

The resolution-changing motor driver unit 22 consists of four drivers each adjusting an inclination of the LD array of a corresponding one of the recording heads 1*a* to 1*b* to a common angle.

The power monitor circuit 23 is connected to the power monitor 10 to derive a power value of laser beam spots emitted from the LD arrays of the recording head assembly 1. The power monitor circuit 23, as shown in FIG. 3, includes a photoelectric transfer element 34, an I-V converter 35, and an ADC (Analog-to-Digital Converter) 36. The photoelectric transfer element 34 provides a current according to the quantity of light of the laser beam spots radiated from the recording head assembly 1. The I-V converter 35 converts the current from the photoelectric transfer element 34 into a voltage. The ADC 36 receives the voltage from the I-V converter 35 to provide a digital signal to the control unit 29.

The PSD circuit 24 has the circuit arrangements, as already discussed with reference to FIG. 4, and provides an output to the control unit 29 through an ADC circuit 37.

Each of the scanning controllers 25, as shown in FIG. 2, includes a linear scale frequency multiplier 26, a linear motor control circuit 27, and a linear motor driver 28. The linear scale frequency multiplier 26 frequency-multiplies a signal having a frequency of, for example, 20 μm outputted from a corresponding one of the position sensor 7 to provide pulse signals each corresponding, for example, 1 μm on the linear scale 6, used to determine an absolute positions of the LD beams, as will be described later in detail. This function of the linear scale frequency multiplier 26 is well known in the art, and explanation thereof in more detail will be omitted here. The linear motor control circuit 27 receives the pulse signals from the linear scale frequency multiplier 26 and a control signal from the control unit 29 to provide a drive signal to the liner motor driver 28. The linear motor driver 28 then operates the linear motor 5 to move a corresponding one of the recording heads 1*a* to 1*d*.

The control unit 29 controls the entire system operation, and has a function of correcting the position of each of the LD beam spots radiated from each of the recording heads 1*a* to 1*d* onto the drum 2 based on the central position of each of the LD beam spots, as will be described later in detail. Additionally, the control unit 29 has functions of moving the recording heads 1*a* to 1*b* to starting positions defined on the recording-areas on the recording medium 3, respectively, and adjusting inclinations of the LD arrays of the recording heads 1*a* to 1*d* to a common angle when changing the resolution of recording images.

An operation of the image recording apparatus 100 will be described below with reference to FIGS. 6(*a*) to 10.

Figures 6A, 6B, 6C:
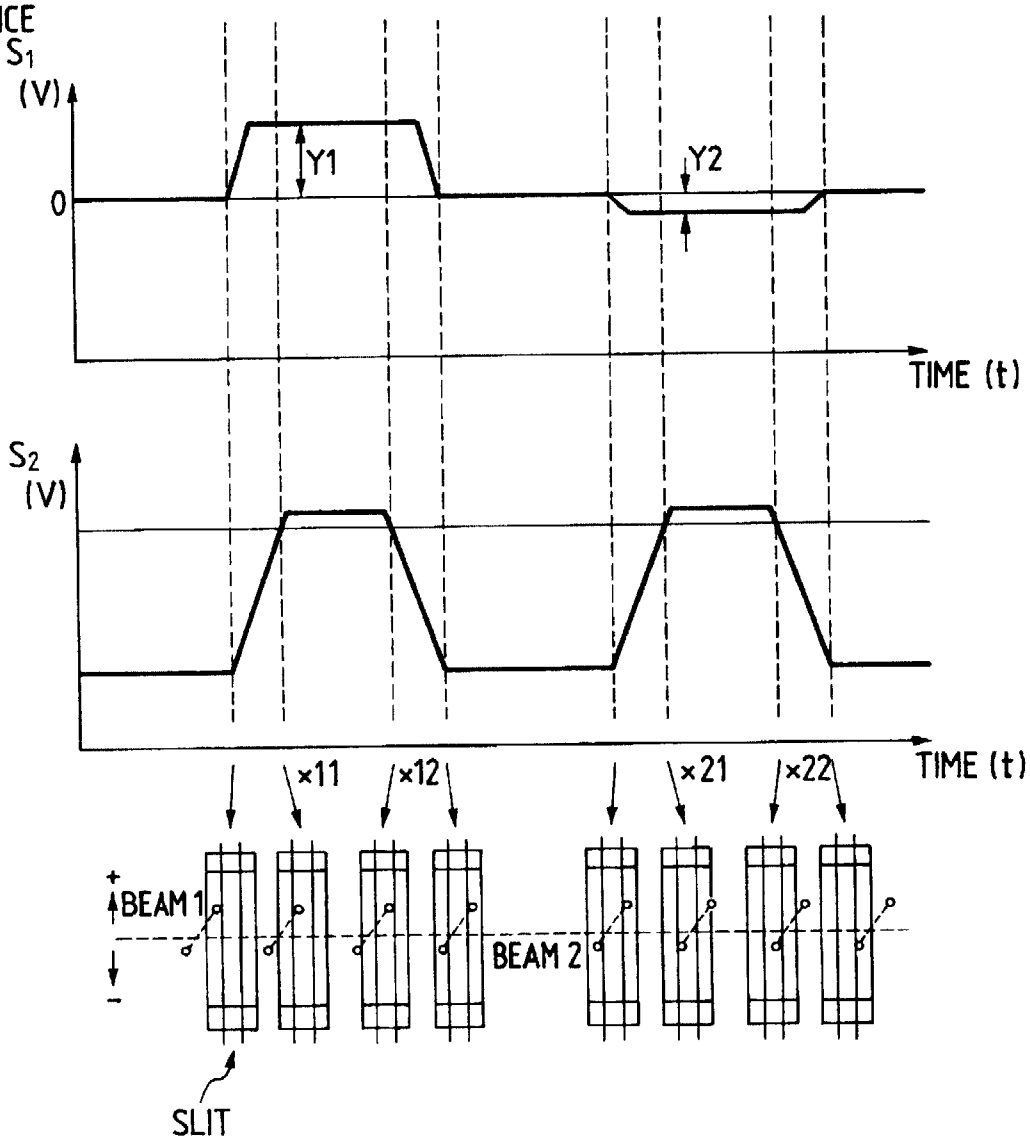
FIGS. 6(*a*) and 6(*b*) are time charts which show signal waveforms of a difference output and a sum output of a PSD 9 for detecting positions of laser beam spots.
Figure 9:
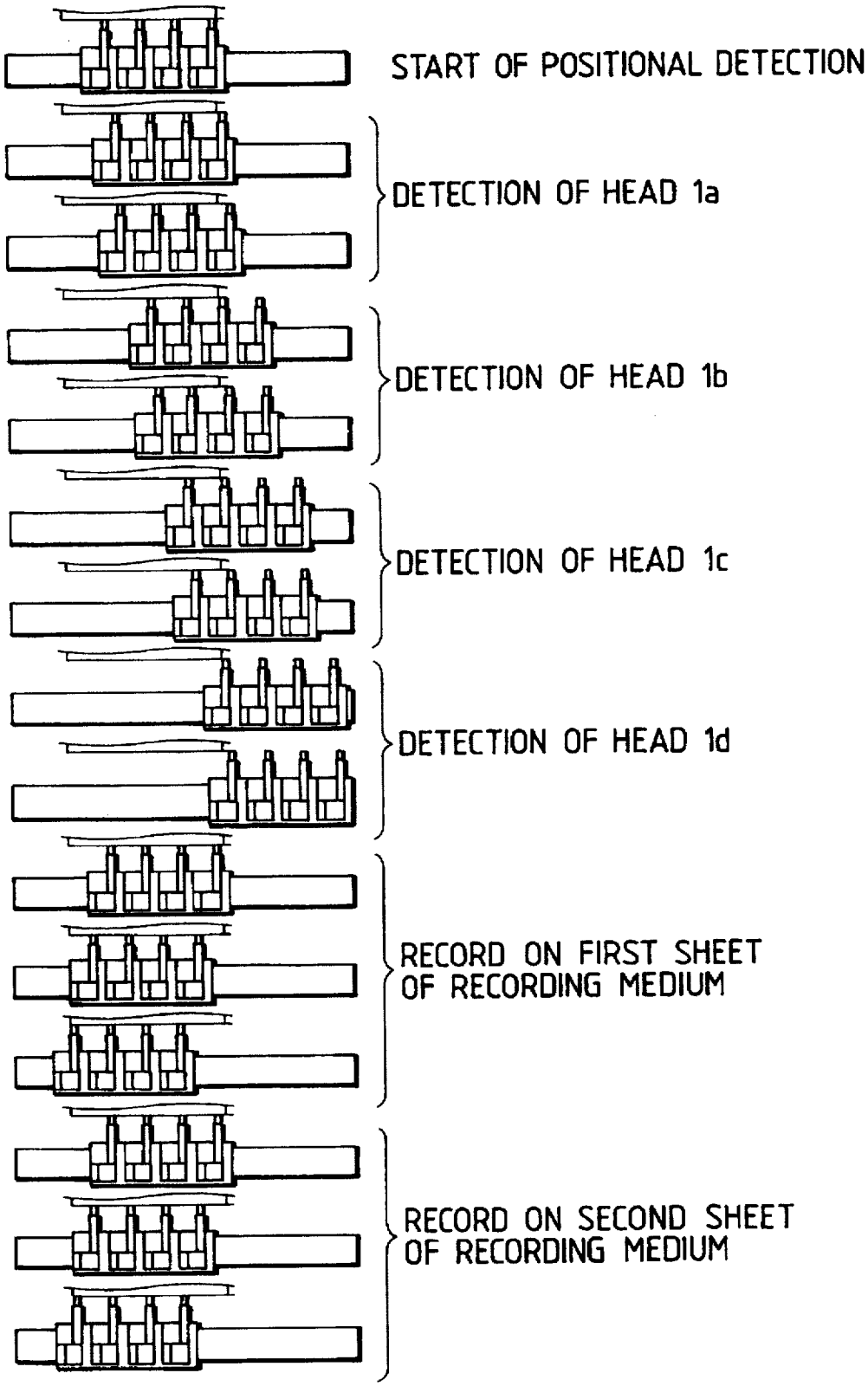
FIG. 9 is an illustration which shows the movement of each recording head after a recording operation is initiated.
Figure 10:
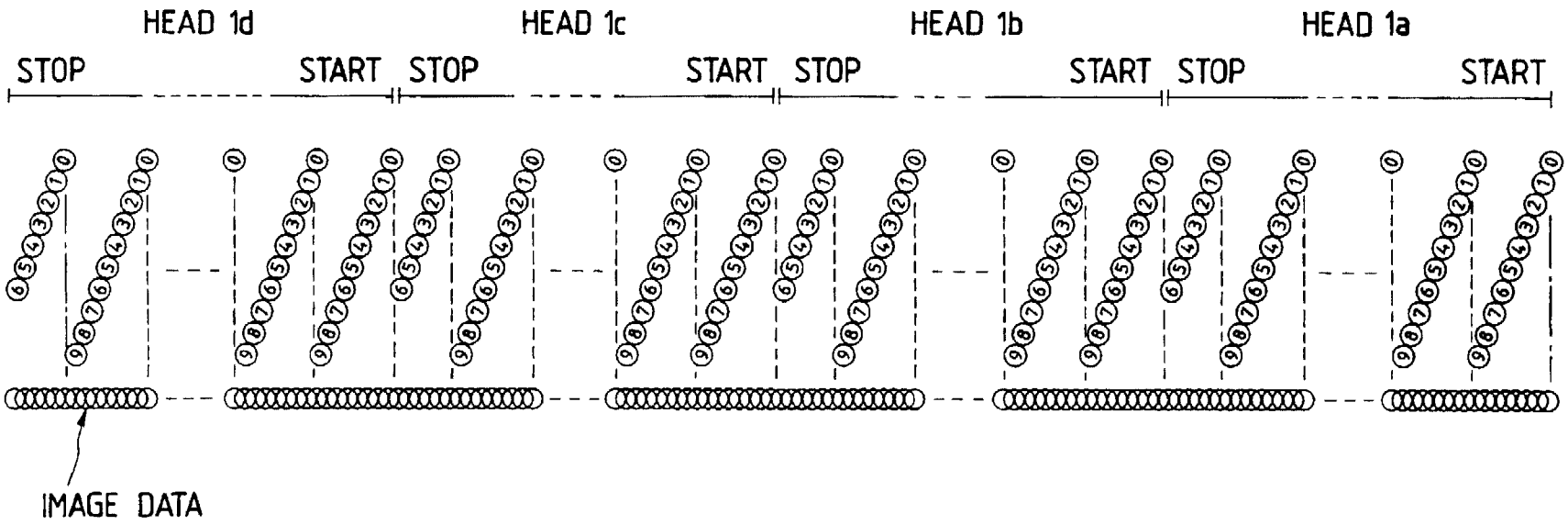
FIG. 10 is an illustration which shows the image recording of each recording head.

FIGS. 6(*a*) and 6(*b*) show signal waveforms outputted from the PSD 9 for detecting positions of laser beam spots radiated from each of the recording heads 1*a* to 1*d*. Beams 1 and 2 are laser beams emitted from the LDs located at both ends of the LD array. Specifically, the beam 1 (hereinafter, referred to as the first beam) represents the first one of the laser beams, while the beam 2 (hereinafter, referred to as the second beam) represents the last one of the laser beams. Ordinate axes indicate the difference output S1 (V) and the sum output S2 (V), respectively, while abscissa axes indicate a time (t). FIG. 9 shows the movement of each of the recording heads 1*a* to 1*d* until recording images on a second sheet of the recording medium 3 is completed after initiation of a recording operation. FIG. 10 shows the movement of the LD array (i.e., laser beam posts) of each of the recording heads 1*a* to 1*d* during the recording operation and image data printed on the recording medium 3 at a given linear density. In the example of FIG. 10, the LD array of each of the recording heads 1*a* to 1*d* consists of ten LDs, as denoted by "0" to "9".

Figure 7:
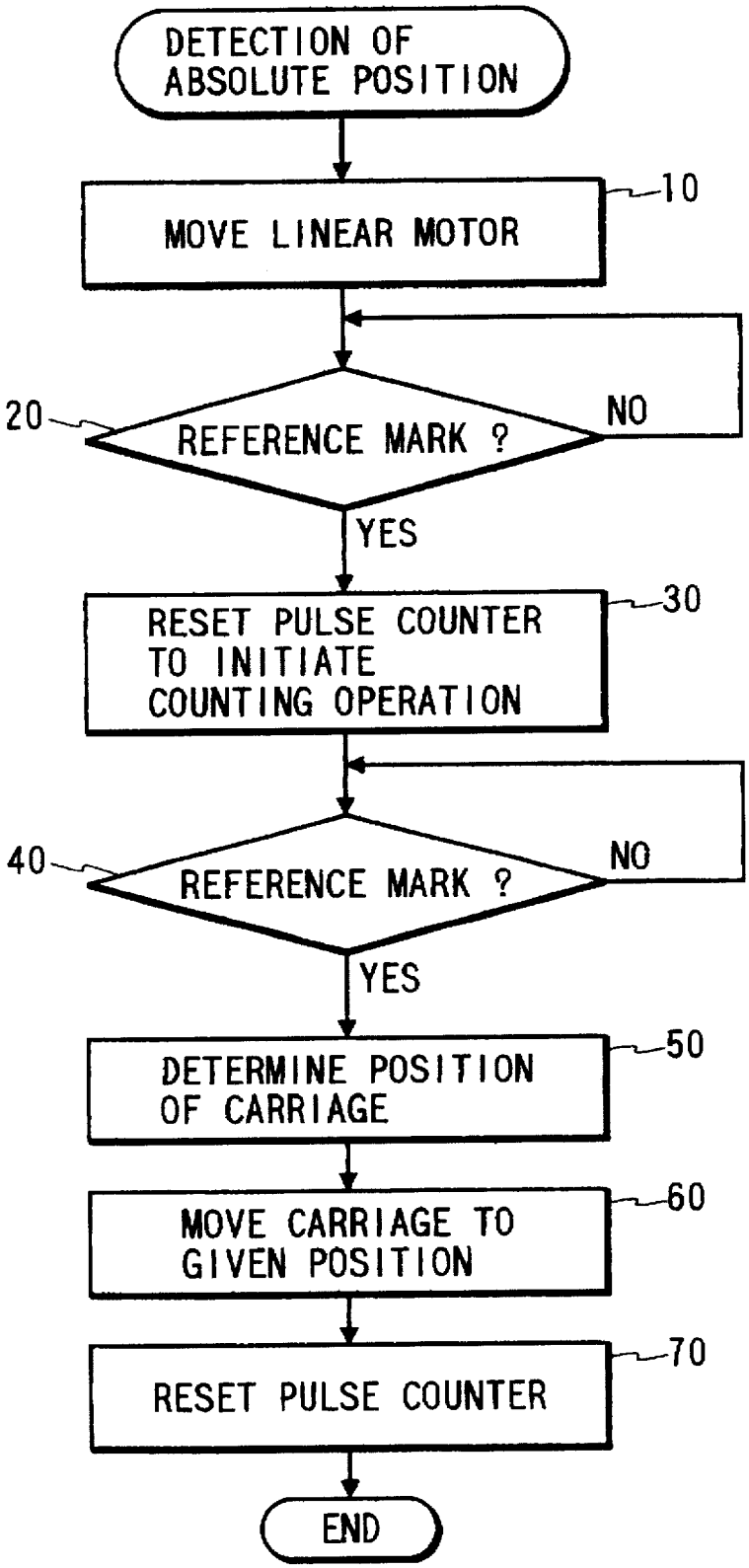
FIG. 7 is a flowchart of a program performed for determining an absolute position of each recording head.

FIG. 7 shows a flowchart of a program or sequence of logical steps performed by the control unit 29 for establishing an absolute position of each of the recording heads 1*a* to 1*b* prior to initiation of a recording operation of the image recording apparatus 100. This program is carried out for every recording head 1*a* to 1*d*, however, explanation below will be made only for the recording head 1*a* for the sake of simplicity.

After entering the program, the routine proceeds to step 10 wherein the linear motor 5 is activated to move the carriage 4 of the recording head 1*a* in the right direction at a given speed. The routine then proceeds to step 20 wherein it is determined whether a first one of absolute address reference indexes printed on the linear scale 6 has been detected or not through the position sensor 7. If a YES answer is obtained, then the routine proceeds to step 30 wherein a count value of a pulse counter installed in the control unit 29 is reset to zero (0) to start counting up the pulse signals outputted from the linear scale frequency multiplier 26, each corresponding to 1 μm on the linear scale 6. The routine then proceeds to step 40 wherein it is determined whether a second one of the absolute address reference indexes has been detected or not. Note that the second one of the absolute address reference indexes is so defined as to be found by moving the carriage 4 at least twenty (20) mm.

If a YES answer is obtained in step 40, then the routine proceeds to step 50 wherein an absolute position of the carriage 4 (i.e., the recording head 1*a*) on the linear scale 6 is determined based on the number of the pulse signals counted between the first and the second of the absolute address reference index. This is based on the fact that in a typical linear scale, a plurality of absolute address reference indexes are printed at different intervals over a measurement range for fixing absolute positions on the scale. Thus, the absolute position of the recording head 1*a* on the linear scale 6 may be measured by finding an interval between adjacent two of the absolute address reference indexes (i.e., the number of the counted pulse signals) through which the recording head 1*a* has passed, and determining an absolute position of the second absolute address reference index through which the recording head 1*a* has last passed.

The routine proceeds to step 60 wherein the carriage 4 or the recording head 1*a* is displaced by the linear motor 5 to a preselected record-stating position. The routine then proceeds to step 70 wherein the pulse counter is reset to zero (0) again.

Figure 8:
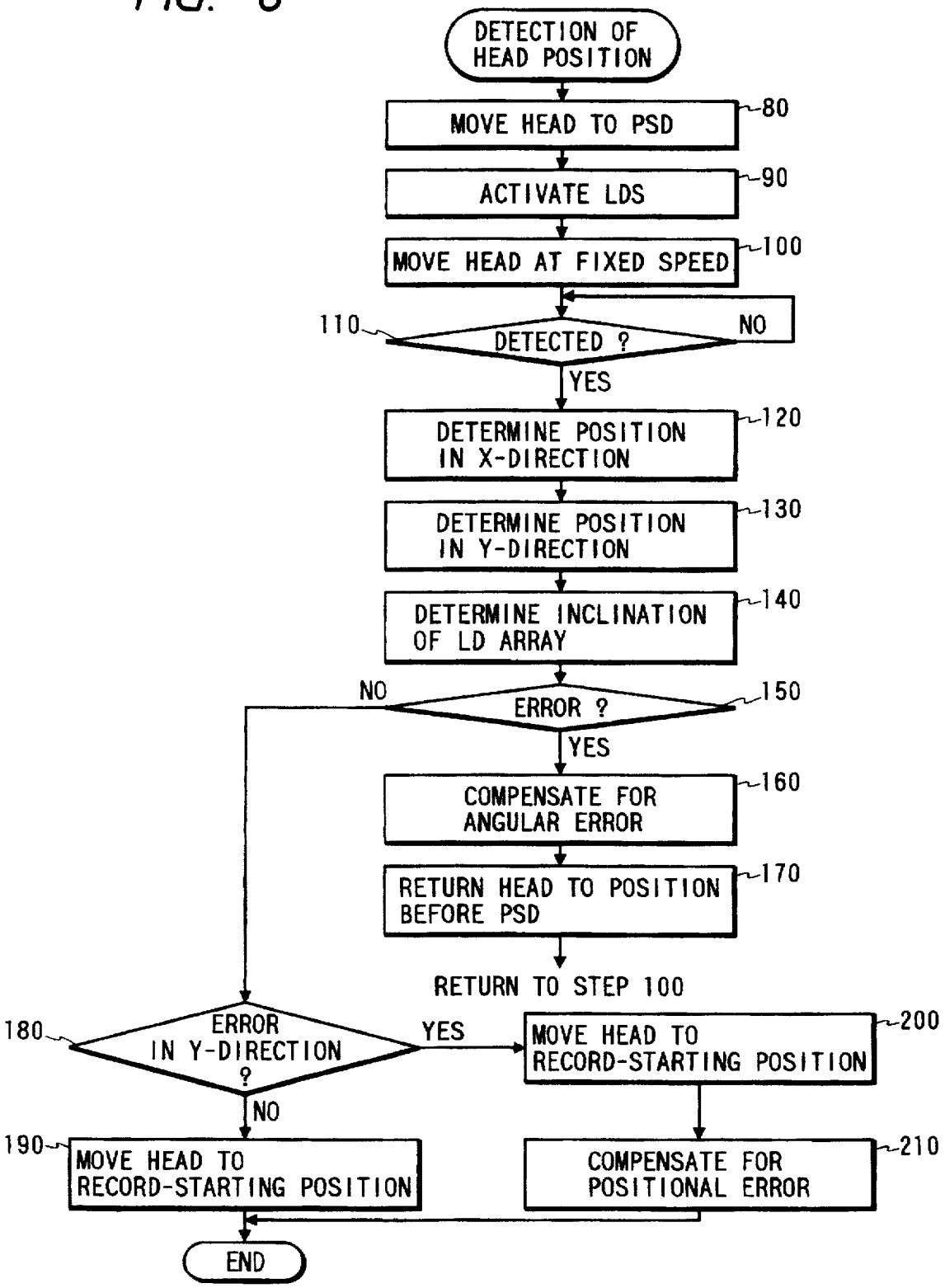
FIG. 8 is a flowchart of a program performed for correcting the position of each recording head relative to a recording medium.

FIG. 8 is a flowchart for detecting through the PSD 9 central positions in the X- and Y-directions of the first and second laser beams radiated onto the drum 2 from each of the recording heads 1*a* to 1*d*. This program is also carried out for every recording head 1*a* to 1*d*, however, explanation below will be made only for the recording head 1*a* for the sake of simplicity.

After entering the program, the routine proceeds to step 80 wherein the recording head 1*a* is moved by the linear motor 5 toward a given detection-starting position. The routine then proceeds to step 90 wherein the LDs of the recording head 1*a* are activated to emit laser beams. The routine then proceeds to step 100 wherein the recording head 1*a* is further moved by the linear motor 5 at a given constant (lower) speed. This step corresponds to step 10 in FIG. 7. Specifically, step 10 and step 100 are performed at the same time. The routine then proceeds to step 110 wherein it is determined whether the first and second laser beams are detected by the PSD 9 or not. If a YES answer is obtained, then the routine proceeds to step 120 wherein central positions of the first and second laser beams in the X-direction are determined based on positional information derived by the linear scale 6. The routine then proceeds to step 130 wherein the difference outputs S1 from the PSD 9 are A-D converted to derive central positions of the first and second laser beams in the Y-direction.

Steps 120 and 130 will be explained in more detail with reference to FIGS. 6(*a*) to 6(*c*).

When the laser beam 1 emitted from the recording head 1*a*, as shown in FIG. 6(*c*), enters an upper portion of a slit of the PSD 9, the difference output S1 rises up to a value Y1. After a certain delay, the sum output S2 rises up to a given value at a time X11. The given value of the sum output S2 is maintained until the laser beam 1 begins to go out of the slit at a time X12, while the value Y1 of the difference output S1 is maintained until the given delay expires following the time X12. Note that the operation of the flowchart in FIG. 7 is completed before the laser beam 1 enters the slit, and an absolute position of the carriage 4 (i.e., the recording head 1*a*) is already fixed.

Similarly, when the laser beam 2 enters a lower portion of the slit of the PSD detector 9, the difference output S1 is lowered to a value Y2. After a certain delay, the sum output S2 rises up to the given value at a time X21. The given value of the sum output S2 is maintained until the laser beam 1 begins to go out of the slit at a time X22, while the value Y2 of the difference output S1 is maintained until the given delay expires following the time X22.

The central positions of the first and second beams (i.e., the laser beams 1 and 2) in the X-direction are determined by reading positional values P11, P12, P21, and P22 out of the position sensor 7 through the scanning controller 25 at the times X11, X12, X21, and X22 to derive X-coordinates X1 and X2, respectively, which are given by the relations of X1=(P11−P12)/2 and X2=(P21−P22)/2. X1 and X2 thus determined represent positions at which the first and second laser beams each pass the longitudinal center line of the slit of the PSD 9. The reason for determining these central positions in a width-wise direction of the slit is for minimizing position-detecting errors of the first and second laser beams since signal levels produced by the PSD 9 when the first and second laser beams enter and go out of the slit may be unstable.

In step 130, Y-coordinates Y1 and Y2 of the first and second laser beams are determined by the values Y1 and Y2 at the positions of X1 and X2, respectively.

Subsequently, the routine proceeds to step 140 wherein an inclination of the LD array of the recording head 1*a* is mathematically determined based on the central positions (i.e., the X-cordinates X1 and X2 and the Y-cordinates Y1 and Y2) of the first and second laser beams in the X- and Y-directions derived in steps 120 and 130. The routine then proceeds to step 150 wherein the inclination of the LD array derived in step 140 is compared with a desired angle to determine whether an angular error is incurred or not. If a YES answer is obtained, then the routine proceeds to step 160 wherein the inclination of the LD array is adjusted by the motor mounted on the recording head 1*a* so as to compensate for the angular error derived in step 150. Note that the compensation for the angular error of the LD array also eliminates a positional error of the LD array in the X-direction.

Subsequently, the routine proceeds to step 170 wherein the recording head 1*a* is returned back to a given position before the PSD 9. The routine then returns back to step 100 wherein the recording head 1*a* is moved through the PSD 9 again. Steps 100 to 170 are repeated until a NO answer is obtained in step 150 meaning that the angular error has been corrected.

If a NO answer is obtained in step 150, then the routine proceeds to step 180 wherein given one of the positions of the first and second laser beams in the Y-direction derived in step 130 during this program cycle is compared with a preselected value to determine whether there is a positional error or not.

If a NO answer is obtained in step 180, then the routine proceeds to step 190 wherein the recording head 1*a* is moved to a predetermined record-starting position. Alternatively, if a YES answer is obtained meaning that there is a positional error in the Y-direction, then the routine proceeds to step 200 wherein the recording head 1*a* is, similar to step 190, moved to the predetermined record-starting position. Note that the recording heads 1*b* to 1*d* are each moved so that the first beam may be emitted on a spot following a spot on which the second beam of a preceding recording head has been emitted. After the steps so far are, as shown in FIG. 9, performed for every recording head 1*a* to 1*d*, the routine proceeds to step 210 wherein the recording operation is initiated, and the emission of the laser beams H, or the activation of the LDs of the recording head 1*a* is timed so as to compensate for the positional error in the Y-direction.

With the above positioning control for each of the recording heads 1*a* to 1*d*, an inclination of a line of the laser beam spots emitted from the LD array of each of the recording heads 1*a* to 1*d* is, as shown in FIG. 10, regulated at the same angle, so that a linear density of each of the recording heads 1*a* to 1*d* assumes a given same value.

Figure 11:
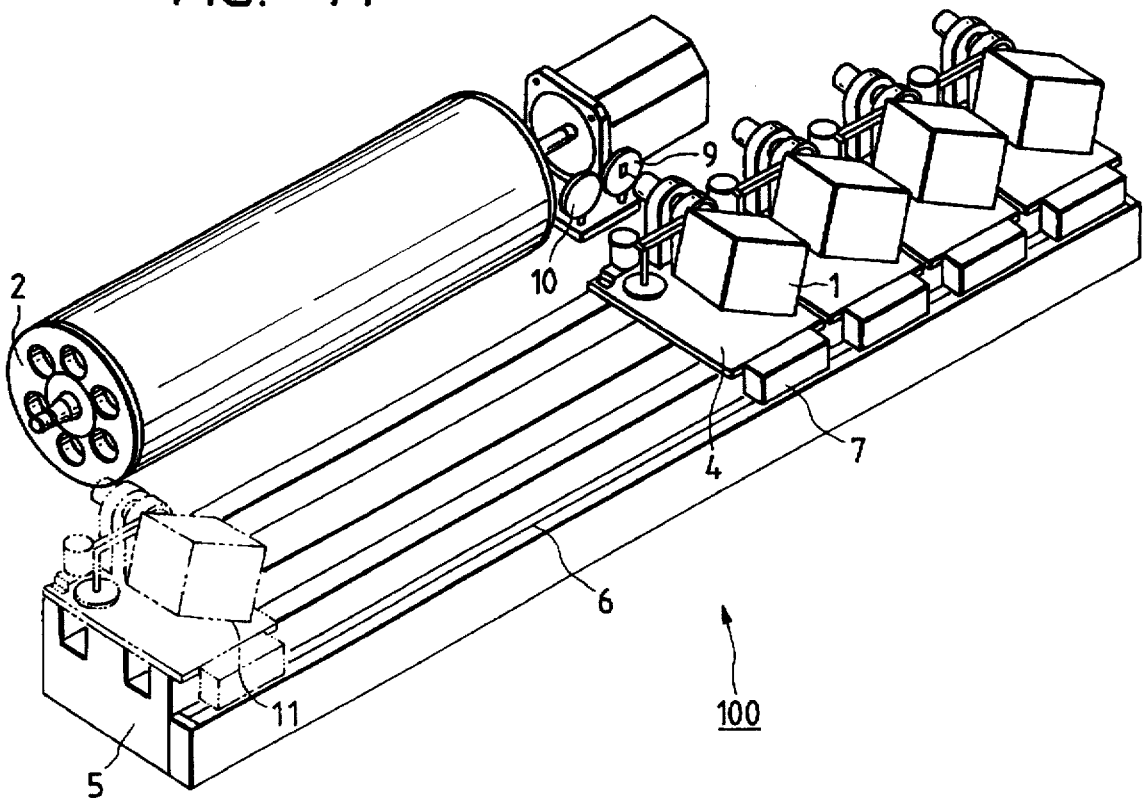
FIG. 11 is a perspective view which shows an image recording apparatus when one of recording heads is broken.
Figure 12:
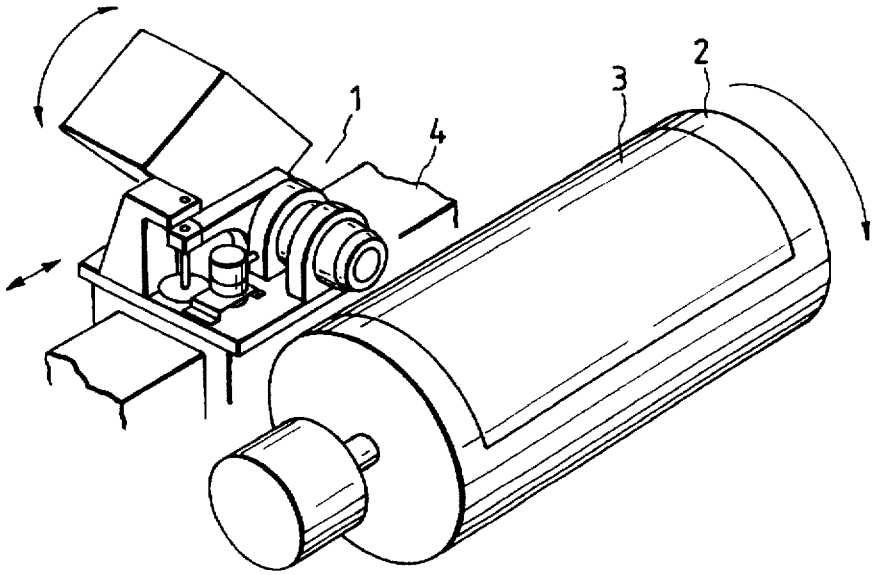
FIG. 12 PRIOR ART
FIG. 12 is a perspective view which shows a conventional image recording apparatus.

FIG. 11 shows an example wherein the recording head disposed at either side of the recording head assembly 1 is damaged. For instance, if it is determined that the recording head 1*d* is malfunctioning based on a decrease in power of the LD array or the fact that it cannot mechanically follow the other recording heads 1*a* to 1*c*, the control unit 29 moves the recording head 1*d* to a broken head storage space provided at the left side of the linear scale 6, and controls the other recording heads 1*a* to 1*c* so as to cover all of the recording areas on the drum 2.

If the recording head 1*a* has malfunctioned, the control unit 29 moves it to a broken head storage space provided at the right side of the linear scale 6, and controls the other recording heads 1*b* to 1*d* so as to cover all of the recording-areas 3*a* to 3*d* on the drum 2.

Alternatively, if either of the recording heads 1*b* and 1*c* has malfunctioned, the control unit 29 turns off the linear motor driver 28 for the malfunctioning recording head without moving the malfunctioning recording head to the broken head storage space, and controls the other normally operating recording heads so as to scan all of the recording areas of the drum 2.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An image recording apparatus comprising:

a plurality of recording heads each emitting a beam spot to form an image on a recording medium provided on a rotatable drum;

moving means for moving said recording heads along a given traveling path substantially perpendicular to a rotational direction of the drum;

position detecting means for detecting positions of the beam spots emitted from said recording heads on the recording medium, respectively, to provide position signals indicative thereof; and correcting means for correcting a position of each of the recording head relative to the recording medium based on the position signals provided by said position detecting means.

2. An image recording apparatus as set forth in claim 1, wherein said position detecting means determines positional components of each of the beam spots in a first direction parallel to the rotational direction of the drum and in a second direction perpendicular to the rotational direction of the drum.

3. An image recording apparatus as set forth in claim 1, wherein each of said recording heads includes an array of light-emitting elements arranged in alignment with each other which emit a plurality of beam spots onto the recording medium, said position detecting means determining an inclination of the array of light-emitting elements of each of said recording heads relative to a direction perpendicular to the rotational direction of the drum based on the positions of the beam spots detected, said correcting means correcting the inclination of the array of light-emitting elements of each of said recording heads to a given common angle.

4. An image recording apparatus as set forth in claim 2, wherein each of said recording heads includes an array of light-emitting elements arranged in alignment with each other which emit a plurality of beam spots onto the recording medium, said position detecting means determining an inclination of the array of light-emitting elements of each of said recording heads relative to a direction perpendicular to the rotational direction of the drum based on the positional components of the beam spots detected, said correcting means correcting the inclination of the array of light-emitting elements of each of said recording heads to a given common angle for compensating for positional errors in the second direction of the beam spots on the recording medium, and also correcting timing of activation of the light-emitting elements of each of said recording heads for compensating for positional errors in the first direction of the beam sports on the recording medium.

5. An image recording apparatus comprising:

a plurality of recording heads each emitting a beam spot to form an image on a recording medium provided on a rotatable drum;

moving means for moving said recording heads along a given traveling path substantially perpendicular to a rotational direction of the drum;

a single position detector detecting positions of the beam spots emitted from said recording heads on the recording medium, respectively; and control means for controlling said moving means to move each of said recording heads to a corresponding record-starting position on the traveling path based on the positions of the beam spots detected by said position detector.

6. An image recording apparatus as set forth in claim 5, further comprising position detecting means for detecting an absolute position of each of said recording heads on a scale provided along the given traveling path for moving each of said recording heads to a corresponding record-starting position.

7. An image recording apparatus comprising:

a plurality of recording heads each forming an image on a recording medium provided on a rotatable drum;

moving units provided one for each of said recording heads, each of said moving units moving a corresponding one of said recording heads along a given traveling path substantially perpendicular to a rotational direction of the drum within a corresponding one of image-recording areas on the recording medium; and control means for controlling said moving units to move said recording heads independently.

8. An image recording apparatus as set forth in claim 7, further comprising position detecting means for detecting an absolute position of each of said recording heads on a scale provided along the given traveling path for moving each of said recording heads to a corresponding record-starting position.

9. An image recording apparatus comprising:

a plurality of recording heads each forming an image on a recording medium provided on a rotatable drum;

moving units provided one for each of said recording heads, each of said moving units moving a corresponding one of said recording heads along a given traveling path substantially perpendicular to a rotational direction of the drum within a corresponding one of image-recording areas on the recording medium;

failure detecting means for detecting failures of said recording heads; and control means for controlling said moving units to move failing one of said recording heads to a given storage space, said control means also controlling the other of the recording heads so as to cover all of the image-recording areas.

* * * * *